United States Patent [19]

Zöchbauer

[11] Patent Number: 4,578,618

[45] Date of Patent: Mar. 25, 1986

[54] LOW-PRESSURE, HOLLOW CATHODE LAMP

[75] Inventor: Michael Zöchbauer, Oberursel, Fed. Rep. of Germany

[73] Assignee: Hartmann & Braun AG, Frankfurt am Main, Fed. Rep. of Germany

[21] Appl. No.: 161,332

[22] Filed: Jun. 20, 1980

[30] Foreign Application Priority Data

Jun. 23, 1979 [DE] Fed. Rep. of Germany ..... 2925410

[51] Int. Cl.[4] ..... H01J 61/28; H01J 61/09

[52] U.S. Cl. ..... 313/563; 313/618

[58] Field of Search ..... 313/545, 563, 562, 561, 313/618

[56] References Cited

U.S. PATENT DOCUMENTS 1,628,256 5/1927 Machlett ..... 313/563

3,699,383 10/1972 Chaney ..... 313/618 X

FOREIGN PATENT DOCUMENTS 2625509 12/1977 Fed. Rep. of Germany ..... 313/618

OTHER PUBLICATIONS

"Low-Power Ion Source", by N. A. Penebre, *IBM Tech. Disclosure Bulletin,* vol. 14, No. 5, p. 1475, Oct. 1971.

*Primary Examiner*—Palmer C. DeMeo

*Attorney, Agent, or Firm*—Ralf H. Siegemund

[57] ABSTRACT

The life of a low-pressure, hollow cathode lamp with an oxygen/nitrogen filling is extended by the inclusion of $MnO_2$ which releases oxygen, thereby replenishing oxygen consumption in the lamp.

3 Claims, 1 Drawing Figure

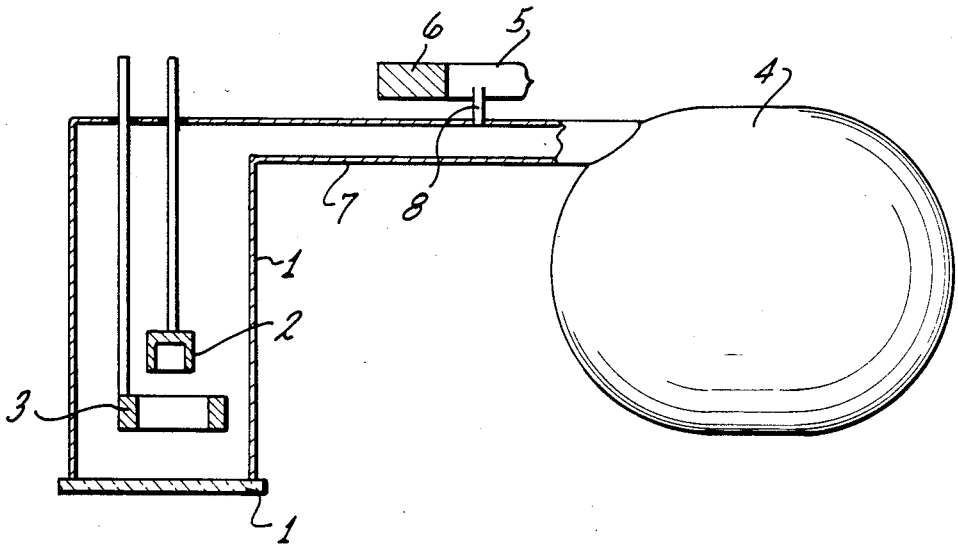
6
5
4
7
8
1
2
3
1

LOW-PRESSURE, HOLLOW CATHODE LAMP

BACKGROUND OF THE INVENTION

The present invention relates to a low-pressure, hollow cathode lamp being filled with nitrogen and oxygen, and in which NO molecules emit radiation upon being energized by a low, electric current.

The German printed patent application No. 2,240,365 discloses such a lamp, particularly for use as a radiation source in a photometric gas analyzer, which is to measure the NO concentration in a mixture of gases. This particular hollow cathode lamp is filled with air at a pressure of from 1 millibar to 5 millibars. The discharge current is kept quite low (at about 1 milliampere, or less) so that the temperature of the air filling in the lamp is and remains almost the same as the ambient temperature.

It is inherent in lamps and radiation sources of the type referred to above that sputtering and clean-up consumes the gases in the body of the lamp; particularly, the oxygen is consumed in time so that, gradually, the intensity of the NO spectrum is reduced. After all of the oxygen has been consumed, the lamp will no longer be able to emit NO molecular resonance radiation.

It is obvious that the extension of the life of such a lamp is an important task. Even more so if such a lamp is the "weak link" in the analyzer of which it forms a part.

DESCRIPTION OF THE INVENTION

It is an object of the present invention to improve low-pressure, hollow cathode lamps emitting NO molecular resonance radiation so that the intensity of the emitted radiation varies very little for as long a period time as possible.

It is a particular object of the present invention to retard a drop in the oxygen content in $N_2$-$O_2$-filled, hollow cathode lamps.

In accordance with the preferred embodiment of the present invention, it is suggested to include, in the lamp, a certain quantity of a metal dioxide, preferably manganese dioxide, to serve as a gradual donor for oxygen, for releasing oxygen, preferably, at a rate comparable with the consumption. Manganese dioxide decomposes into manganic oxide ($Mn_2O_3$) and oxygen at higher temperatures (535° C.); but under reduced pressure at low temperatures, a decompositioning dependent on the oxygen partial pressure in the lamp volume can be observed.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawing, in which The FIGURE illustrates somewhat schematically a hollow cathode lamp in accordance with the preferred embodiment of the invention for practicing the best mode thereof.

The FIGURE shows, in particular, a lamp body or vessel 1 of hollow, enclosed configuration and containing a hollow cathode 2 and an anode 3. The interior of this vessel is filled with a mixture, comprising about 10% $O_2$ and 90% $N_2$ at a total pressure of about 5 mbar. The lamp has a window 1' through which the radiation passes as produced on discharge between anode and cathode.

The lamp includes, in addition, a reservoir 4, containing also oxygen and nitrogen, and communicating with the lamp proper via a duct 7. Reservoir 4 provides for regular replenishing of the consumed oxygen.

In order to retard the drop of oxygen content in the lamp, a small capsule 5, or the like, is mounted on duct 7 and communicates therewith by means of a small tube 8. Manganese dioxide 6 is disposed in capsule 5, fixed by a small amount of glass wool or wadding. This particular oxide is exposed to the interior of the lamp and will gradually release oxygen in order to replenish the consumption thereof. Considering a volume of lamp plus reservoir of about 7,000 cubic centimeters, one may use about 3,000 milligrams of $MnO_2$.

The construction, as illustrated, demonstrates that the invention can be practiced as a supplement to existing lamp constructions. It will pose no problem to find a place to which one may affix this supplemental capsule 5.

The invention is not limited to the embodiments described above; but all changes and modifications thereof, not constituting departures form the spirit and scope of the invention, are intended to be included.

I claim:

1. A low-pressure, hollow cathode lamp, containing in its interior nitrogen and oxygen for emitting nitrogen oxide molecule resonance radiation, the improvement comprising a quantity of manganese dioxide provided for exposure to the interior of the lamp, for replenishing consumed oxygen by gradually releasing oxygen as bonded in the dioxide.

2. A lamp as in claim 1, there being a separate capsule containing the manganese dioxide, the capsule communicating with the interior of that portion of the lamp containing the cathode.

3. A lamp as in claim 2, the manganese dioxide being fixed by glass wool or wadding.

* * * * *